US006158153A

United States Patent [19]

Morgan

[11] Patent Number: 6,158,153

[45] Date of Patent: Dec. 12, 2000

[54] CRAFT HOOP STAND

[76] Inventor: Robert Elliott Morgan, 30560 Elise Ann, Bulverder, Tex. 78163

[21] Appl. No.: 09/392,203

[22] Filed: Sep. 8, 1999

[51] Int. Cl.[7] ..... D06C 3/08

[52] U.S. Cl. ..... 38/102.2

[58] Field of Search ..... 38/102.1, 102.2, 38/102.3, 102.9, 102.91; 112/103; 101/127.1; 160/380, 377

[56] References Cited

U.S. PATENT DOCUMENTS

| | | | |
|---|---|---|---|
| D. 309,057 | 7/1990 | Peters . | |
| D. 309,058 | 7/1990 | Peters . | |
| 396,073 | 1/1889 | Cory . | |
| 406,119 | 7/1889 | White . | |
| 1,378,826 | 5/1921 | Snelling et al. | 38/102.1 |
| 1,700,666 | 1/1929 | Bright | 38/102.2 |
| 3,237,778 | 3/1966 | Hoodis | 160/380 |
| 3,309,803 | 3/1967 | Wilson . | |
| 3,750,312 | 8/1973 | Bucher . | |
| 4,485,574 | 12/1984 | Bennetot | 38/102.2 |
| 4,549,366 | 10/1985 | Gerding et al. . | |
| 4,827,638 | 5/1989 | Peters . | |
| 5,119,572 | 6/1992 | Graham . | |
| 5,327,665 | 7/1994 | Manning et al. . | |
| 5,488,789 | 2/1996 | Religa et al. . | |
| 5,609,119 | 3/1997 | Yeh | 38/102.2 X |

*Primary Examiner*—Ismael Izaguirre
*Attorney, Agent, or Firm*—Shughart Thomson & Kilro P.C.

[57] ABSTRACT

An improved craft hoop stand comprises two different sized craft hoop sets removably secured together in spaced apart relation by a plurality of rods whose ends are removably securable within holes extending into bosses extending inwardly from an inner ring of each craft hoop set. The stand is adapted for selectively supporting one of the craft hoop sets above a surface such as the lap of a user. The craft hoop sets are removably securable together such that the hoops may be used separately.

7 Claims, 2 Drawing Sheets

CRAFT HOOP STAND

BACKGROUND OF THE INVENTION

The present invention relates to craft hoops and more particularly to a craft hoop stand for supporting a craft hoop above the lap of a user or other support surface.

Craft hoops or craft hoop sets generally comprise concentric inner and outer rings. The inner ring has a fixed diameter and the outer ring has an adjustable diameter. Material upon which a craft is to be performed is placed across the inner ring. The outer ring is then placed over the material and around the inner ring and the diameter of the outer ring is then adjusted such that the outer ring fits snugly against the material and inner ring so as to hold the material between the two rings. Craft work is then performed on the material held taut between the two rings.

While performing craft work on material secured between the rings, it is necessary for the worker to access the space below as well as the space above the material held between the rings for manipulation of a needle relative thereto. Having to constantly maneuver the craft hoop set while performing the craft work to gain the appropriate access can be tiresome. Although stands have been developed for supporting a craft hoop set for a worker while performing the craft work, existing stands tend to be relatively cumbersome, complicated or expensive. Many of the existing stands are too large or too cumbersome to conveniently transport from place to place. Other stands are adapted for use with only one size hoop set. Craft workers typically utilize hoop sets of more than one size to accommodate different sizes or types of projects.

There remains a need for a craft hoop stand for supporting a craft hoop set above a surface which is readily transportable, easy to assemble and allows for use of craft hoop sets of more than one size.

SUMMARY OF THE INVENTION

The present invention generally comprises an improved craft hoop stand having two different sized craft hoop sets removably secured together in spaced apart relation by a plurality of rods whose ends are removably securable within holes extending into projections extending inwardly from the inner ring of each craft hoop set. When assembled, the stand can be used for selectively supporting one of the craft hoop sets above a surface such as the lap of a user. The craft hoop sets are removably securable together such that the hoops may be used separately.

OBJECTS AND ADVANTAGES OF THE INVENTION

Therefore, it is an object of the invention to provide an improved craft hoop stand for supporting a craft hoop set above a surface such as the lap of a user; to provide such a craft hoop stand which can be used for supporting different sized craft hoop sets; to provide such a stand in which the craft hoop sets are removably securable to the stand such that the craft hoop sets may be used separately from the stand; to provide such a craft hoop stand that is relatively simple and inexpensive to manufacture; to provide such a craft hoop stand which is simple to use; and to provide such a craft hoop stand which is particularly well adapted for its intended usage.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
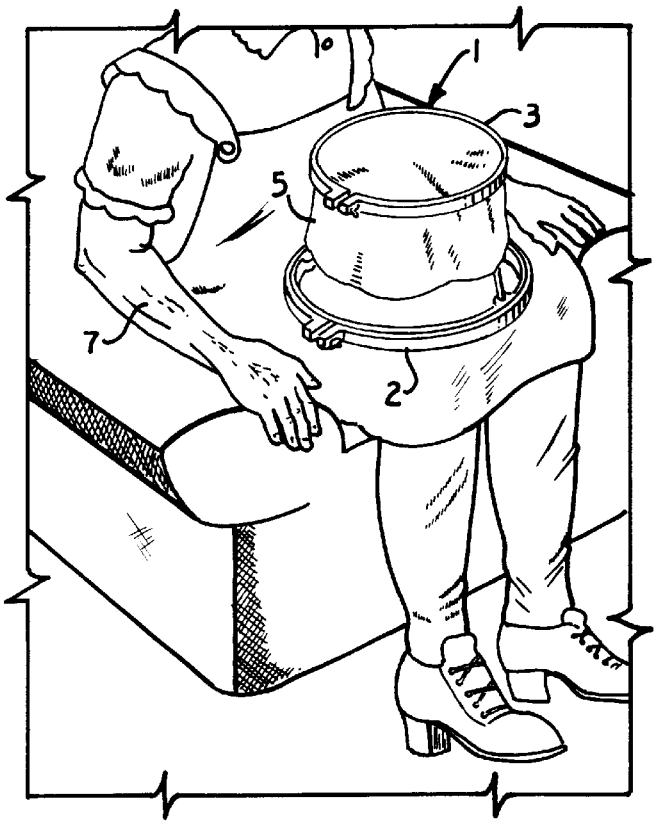
FIG. 1 is a fragmentary perspective view showing a craft hoop stand of the present invention supported in the lap of a user and with material on which a craft is to be performed secured thereto.
Figure 2:
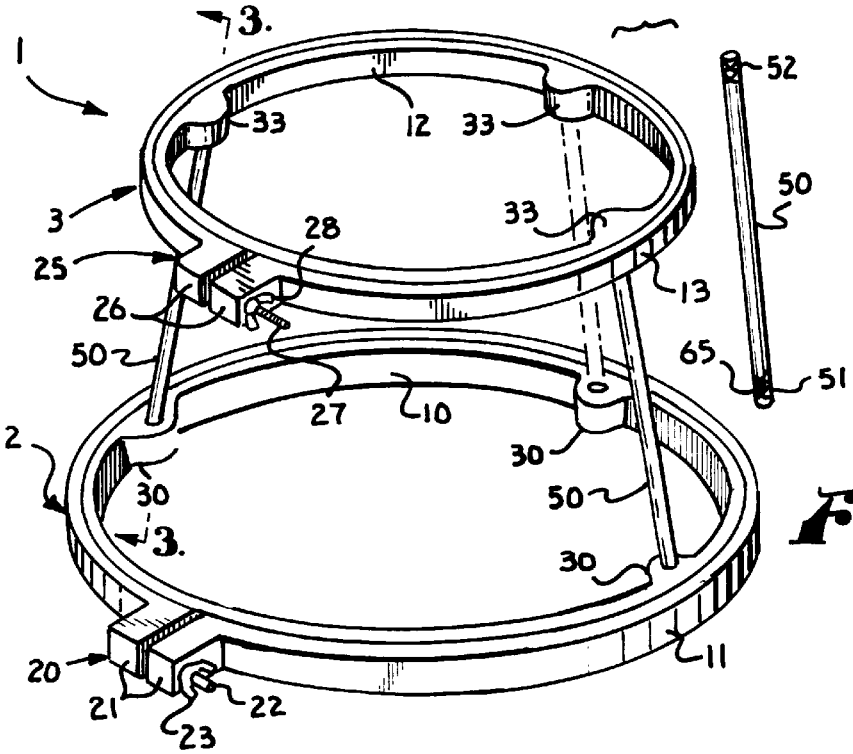
FIG. 2 is an enlarged and exploded perspective view of the craft hoop stand of the present invention.

Referring to the drawings in more detail, the reference numeral 1 refers to an improved craft hoop stand of the present invention generally comprising a first craft hoop set 2 and a second craft hoop set 3 of different sizes removably secured together with each of the hoops adapted for use in securing thereto material 5 on which a craft is to be performed. As shown in FIGS. 1 and 2 the first craft hoop set 2 is larger in diameter than the second craft hoop set 3. The craft hoop sets 2 and 3 utilized are generally sized such that the stand 1 can be supported in the lap of a user 7 and such that the craft hoop sets 2 and 3 can accommodate materials 2 from a wide range of crafts including: needlepoint, embroidery and quilting.

The craft hoop sets 2 and 3 are removably securable together such that each craft hoop set 2 and 3 can be used separately for securing material 5 on which a craft is to be performed. Alternatively, the craft hoop sets 2 and 3 can be secured together to form the stand 1 such that the material 5 on which a craft is to be performed is secured to one of the craft hoop sets 2 or 3. The other craft hoop set 2 or 3 functions as a base for supporting the other craft hoop set 2 or 3 above a surface such as the lap of a user 7.

The first craft hoop set 2 comprises an inner ring or hoop 10 and a split outer ring or hoop 11. The second craft hoop set 3 comprises an inner ring or hoop 12 and a split outer ring or hoop 13. In the preferred embodiment the rings or hoops 10, 11, 12 and 13 are formed from plastic but it is foreseeable that the rings may be formed from a wide variety of material including wood, metal or other fairly rigid materials.

The outer ring 11, of the first craft hoop set 2, includes clamping means such as clamp 20 for adjusting the diameter of the outer ring 11. Clamp 20, as shown, comprises a pair of opposed ears 21, each mounted on an end of the split outer ring 11, and also includes a bolt 22 extending through coaxial apertures in each ear 21 to be secured by a nut 23. The outer ring 11 is sized such that the outer ring 11 may be positioned in encircling or circumscribing alignment with the inner ring 10. Tightening of the nut 23 on the bolt 22 urges the ears 21 and the ends of the outer ring 11 together so as to reduce the diameter of the outer ring 11 and to generally constrict the outer ring 11 around the inner ring 10.

The outer ring 13, of the second craft hoop set 3, includes clamping means such as clamp 25 for adjusting the diameter of the outer ring 13. Clamp 25, as shown, comprises a pair of opposed ears 26, each mounted on an end of the split outer ring 13, and also includes a bolt 27 extending through coaxial apertures in each ear 26 to be secured by a nut 28. The outer ring 13 is sized such that the outer ring 13 may be positioned in encircling or circumscribing alignment with the inner ring 12. Tightening of the nut 28 on the bolt 27 urges the ears 26 and the ends of the outer ring 13 together so as to reduce the diameter of the outer ring 13 and to generally constrict the outer ring 13 around the inner ring 12.

Three protuberances or bosses 30 are formed on and extend inwardly from an inner surface of the inner ring 10 of the first craft hoop set 2 in equally spaced apart relationship. Similarly three protuberances or bosses 33 are formed on and extend inwardly from an inner surface of the inner ring 12 of the second craft hoop set 3 in equally spaced apart relationship.

Figure 3:
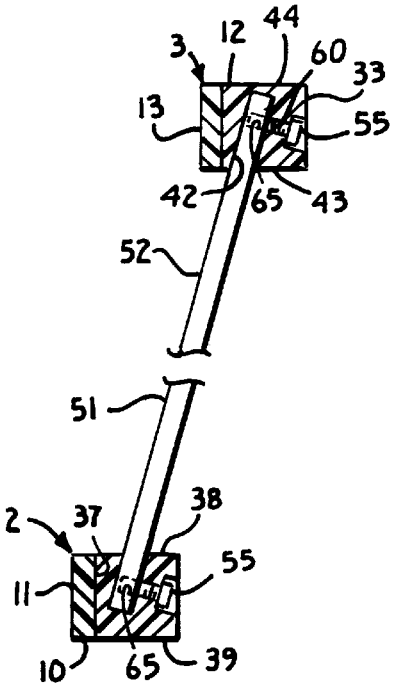
FIG. 3 is an enlarged and fragmentary cross-sectional view taken along line 3—3 of FIG. 2.

Referring to FIG. 3, a first leg receiving bore 37 is formed in and extends at least partially into each of the bosses 30 on the inner ring 10 of the first craft hoop set 2. The bores 37 extend into the bosses 30 from an upper surface 38 of the bosses 30 and craft hoop set 2 toward a lower surface 39 thereof. The bores 37 in the bosses 30 are angled outward from the upper surface 38 toward the lower surface 39.

A second leg receiving bore 42 is formed in and extends at least partially into each of the bosses 33 on the inner ring 12 of the first craft hoop set 3. The bores 42 extend into the bosses 33 from a lower surface 43 of the bosses 33 toward an upper surface 44 thereof. The bores 42 in the bosses 33 are angled inward from the lower surface 43 toward the upper surface 44. The angle at which the bores 37 are angled outward from the upper surface 38 toward the lower surface 39 of each boss 30 is the same angle at which the bores 42 are angled inward from the lower surface 43 toward the upper surface 44 of each boss 33.

Three rods or legs 50 each having knurled first and second ends 51 and 52 are adapted for use in securing the first and second craft hoop sets 2 and 3 together. Each of the first ends 51 of the legs 50 are sized for insertion into one of the first leg receiving bores 37 for frictional engagement therein. Each of the second ends 52 of the legs 50 are sized for insertion into one of the second leg receiving bores 42 for frictional engagement therein.

The stand 1 is formed by securing the first and second craft hoop sets 2 and 3 together by securing legs 50 in aligned sets of the first and second leg receiving bores 37 and 38 in the respective craft hoop sets 2 and 3. The legs 50 may be more securely attached to the craft hoop sets with sets screws 55 as best seen in FIG. 3. A set screw 55 is threadingly secured within a threaded bore 60 formed in each of the bosses 30 and 33. The threaded bores 60 are preferably countersunk such that the ends of set screws 55 do not extend past the surface of the bosses 30 and 33 when tightened down.

A set screw receiving bore 65 is formed in each end 51 and 52 of the legs 50 for reception of the end of one of the set screws 55 for securing the end of the leg in the associated leg receiving bore 37 or 42. The set screw receiving bore 65 is preferably beveled to facilitate alignment of the set screw receiving bore 65 with the threaded bore 60.

Figure 4:
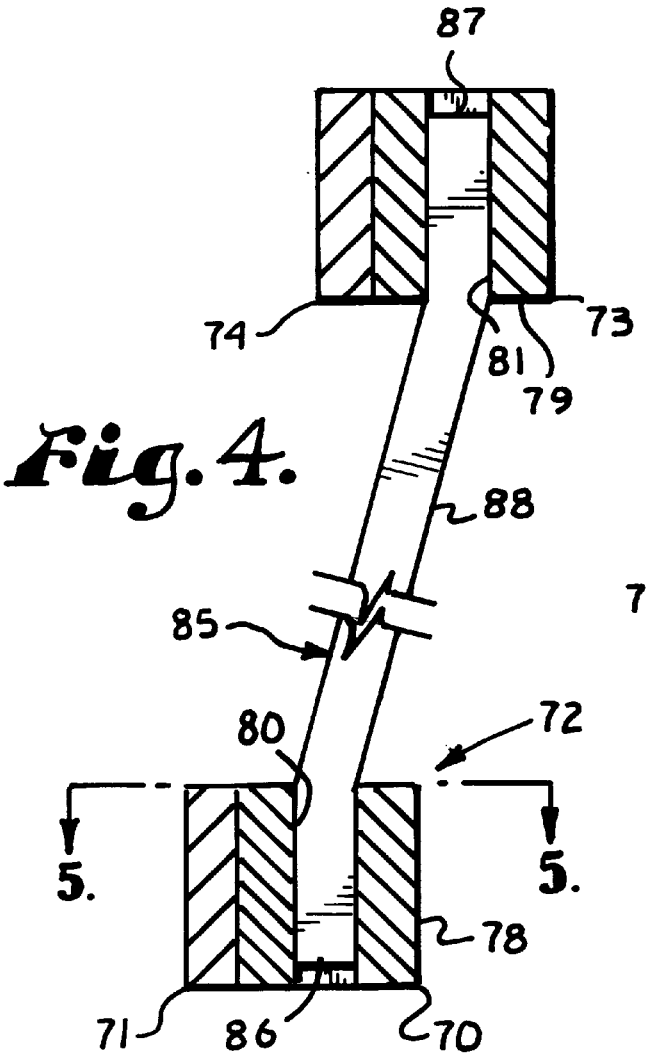
FIG. 4 is a view similar to FIG. 3 showing an enlarged and fragmentary cross-sectional view of an alternative embodiment of the craft hoop stand.
Figure 5:
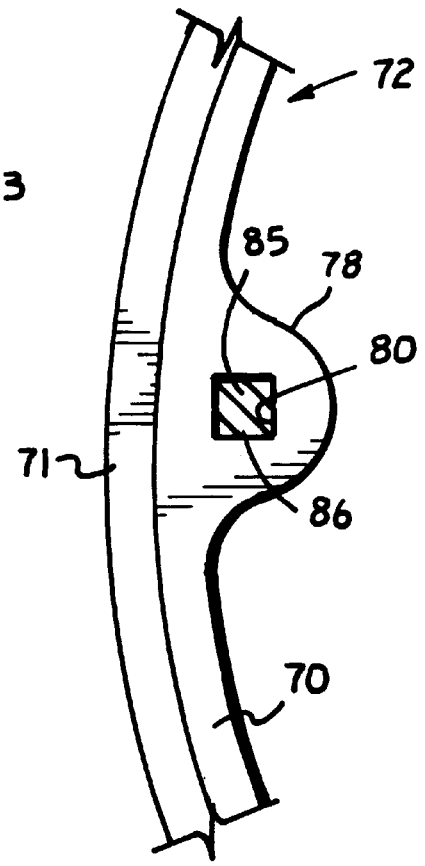
FIG. 5 is an enlarged and fragmentary cross-sectional view taken generally along line 5—5 of FIG. 4.

A alternative embodiment 69 of the stand is shown in FIG. 4. The stand 69 is of similar construction as stand 1 except as described below. The alternative embodiment comprises an inner ring 70 and an outer ring 71 of a first craft hoop set 72 and an inner ring 73 and an outer ring 74 of a second craft hoop set 75. A plurality of bosses 78, preferably three, are formed on an inner surface of the inner ring 70 of the first craft hoop set 72. Similarly, a plurality of bosses 79, preferably three, are formed on an inner surface of the inner ring 73 of the second craft hoop set 75. A leg receiving bore 80 extends through each boss 78 generally perpendicular to upper and lower surfaces of the boss 78. Similarly a leg receiving bore 81 extends through each boss 79 generally perpendicular to upper and lower surfaces of the boss 78. As generally shown in FIG. 5, the leg receiving bores 80 and 81 preferably have a square cross-section.

A plurality of rods or legs 85, each having first and second ends 86 and 87 and a mid-section 88, are adapted for use in securing the first and second craft hoop sets 72 and 75 together. The first and second ends 86 and 87 of legs 85 are each angled at an obtuse angle relative to the mid-section 88 and extend parallel to one another. Each of the ends 86 and 87 of the legs 85 are sized for insertion into either of the first or second leg receiving bores 80 or 81 for frictional engagement therein. The ends 86 and 87 are generally shorter than the bores 80 and 81 into which they are inserted such that no portion of the ends 86 and 87 extend beyond the bores 80 and 81 when the stand 69 is assembled.

The craft hoop sets 72 and 75 are secured together using legs 85 to form the stand 69. The first craft hoop set 72 is generally placed on a flat surface and the first ends 86 of legs 85 are inserted in the first leg receiving bores 80 of each of the bosses 78 on the inner ring 70. Abutment of the mid-section 88 of each leg 85, at the angled transition between the mid-section 88 and the first end 86, against an upper surface of the respective boss 78, prevents the first end 86 from extending completely through the leg receiving bore 80 in the boss 78. The legs 85 are attached to the inner ring 70 of the first craft hoop set 72 such that the second ends 87 of the legs are positioned for alignment with the second leg receiving bores 81 in the bosses 79 on the second craft hoop set 75.

The second craft hoop set 75 is positioned over the legs 85 such that the second ends 87 of the legs 85 are aligned with the second leg receiving bores 81 in the bosses 79 on the inner ring 73 of the second craft hoop set 75. The second craft hoop set 75 is then pressed onto the legs such that the second ends 87 of legs 85 extend into the aligned leg receiving bores. Abutment of the mid-section 88 of each leg 85, at the angled transition between the mid-section 88 and the second end 87, against a lower surface of the respective boss 79, prevents the second end 87 from extending completely through the leg receiving bore 81 in the boss 79. The square cross-section of the legs 85 and the leg receiving bores 80 and 81 prevents rotation of the legs 85 within the bores 80 and 81.

It is foreseen that a wide variety of other means could be utilized for securing the ends of the legs to the craft hoop sets. For example, the ends of the legs could include clips for clipping to the respective inner rings of the craft hoop sets. Alternatively, the ends of the legs could have holes formed therein adapted to snap onto a post extending inwardly from an inner surface of the respective inner rings. Further, the set screws 55 could incorporate enlarged heads extending outward from the inner surface of the inner rings to facilitate manual tightening.

In use, after the stands 1 or 69 are assembled, the user 7 selects the size of the craft hoop set appropriate for the project. The stand 1 is supported on a surface such as the lap of a user 7 such that craft hoop set on which work is to be performed is spaced above the support surface with the other craft hoop set generally functioning as a base. The design of the stand 1 supports the selected craft hoop set above the support surface such that the underside of material secured to the selected craft hoop set is accessible to the user 7 without the need for having to hold onto the craft hoop set.

It is to be understood that while certain forms of the present invention have been illustrated and described herein, it is not to be limited to the specific forms or arrangement of parts described and shown.

What is claimed and desired to be secured by Letters Patent is as follows:

1. A craft hoop stand comprising a first craft hoop set of a first diameter removably securable in spaced apart relationship to a second craft hoop set of a second diameter by a plurality of legs having opposite ends which are removably insertable into leg receiving bores in respective inner rings of said first and second craft hoop sets.

2. A craft hoop stand comprising a first craft hoop set of a first diameter removably securable in spaced apart relationship to a second craft hoop set of a second diameter by a plurality of legs having opposite ends removably securable to respective inner rings of said first and second craft hoop sets.

3. A craft hoop stand comprising:

(a) a first craft hoop set including a first inner ring and a first outer ring; said first inner ring having a plurality of first bosses connected to and extending inwardly therefrom; each of said first bosses on said first inner ring having a first bore extending therein from an inner face thereof;

(b) a second craft hoop set which is smaller in diameter than said first craft hoop set; said second craft hoop set including a second inner ring and a second outer ring; said second inner ring having a plurality of second bosses connected to and extending inwardly therefrom; each of said second bosses on said second inner ring having a second bore extending therein from an inner face thereof; and (c) a plurality of support members having opposite ends sized for insertion in said first and second bores in said first and second bosses of said first and second inner rings for supporting said first and second craft hoop sets in spaced apart relation.

4. The craft hoop stand as in claim 3 wherein:

(a) said opposite ends of said support members are knurled and sized for securement within said first and second bores of said first and second bosses on said first and second inner rings by frictional engagement.

5. The craft hoop stand as in claim 3 wherein:

(a) each of said support members has first and second ends and a mid-section wherein said first and second ends are angled relative to said mid-section and extend parallel to one another; and (b) said first and second bores extend transverse relative to said first and second bosses respectively.

6. The craft hoop stand as in claim 3 wherein:

(a) said first bores in said first bosses on said first inner ring are angled outward from said inner face to an outer face thereof;

(b) said second bores in said second bosses on said second inner ring are angled inward from said inner face to an outer face thereof; and (c) said support members are straight.

7. The craft hoop stand as in claim 6 further comprising:

(a) a screw secured within a threaded bore extending through each of said first and second bosses into said first and second bore therein; said screw threadingly advanceable for engaging one of said ends of each of said support members.

* * * * *